US005946987A

United States Patent [19]

Wei

[11] Patent Number: 5,946,987

[45] Date of Patent: Sep. 7, 1999

[54] OFFSET RATCHET WRENCH

[76] Inventor: Hung-Yin Wei, No. 21, Lane 255, Tai-Ping Road, Tai-Ping City, Taichung Hsien, Taiwan

[21] Appl. No.: 08/966,178

[22] Filed: Nov. 7, 1997

[51] Int. Cl.[6] ..... B25B 13/46

[52] U.S. Cl. ..... 81/63.2; 81/63

[58] Field of Search ..... 81/60, 61, 62, 81/63, 63.1, 63.2

[56] References Cited

U.S. PATENT DOCUMENTS

| | | | |
|---|---|---|---|
| 4,112,792 | 9/1978 | Guimarin | 81/63 |
| 4,722,253 | 2/1988 | Chow | 81/62 |
| 4,748,875 | 6/1988 | Lang | 81/63 |
| 5,119,701 | 6/1992 | Wei | 81/63 |
| 5,325,744 | 7/1994 | Horikawa | 81/63.2 |
| 5,603,247 | 2/1997 | Wei | 81/63.2 |

*Primary Examiner*—David A. Scherbel
*Assistant Examiner*—Joni B. Danganan
*Attorney, Agent, or Firm*—Rosenberg, Klein & Bilker

[57] ABSTRACT

An offset ratchet wrench is provided having a base seat disposed between upper and lower bars. The base seat is an elongated member, including two lateral faces which are not in contact with the upper and lower bars. A top face of the base seat contacts the upper bar and a bottom face of the base seat contacts the lower bar. At least one pair of locating projections are respectively disposed on the top and bottom faces of the base seat for preventing the base seat from longitudinal or transverse sliding between the upper and lower bars.

3 Claims, 5 Drawing Sheets

OFFSET RATCHET WRENCH

BACKGROUND OF THE INVENTION

The present invention relates to a base seat of a ratchet wrench, which is formed with locating projections for easily and reliably securing the base seat.

FIG. 1 shows a conventional ratchet wrench 1A the end section of which is not bent up. It is necessary to secure the base seat 2 of the wrench with two rivets 11 which are passed through the base seat 2.

FIG. 2 shows another type of conventional ratchet wrench 1B the end section of which is bent up. The base seat 2 of such wrench is also secured by two rivets 11 passing through the base seat 2. However, in order to assemble the upper and lower bars 3, 4, the distance D1 between the rivet holes of the upper bar 3 should be unequal to the distance D2 between the rivet holes of the lower bar 4. Therefore, in manufacturing, the upper and lower bars 3, 4 must be produced respectively and cannot be commonly used.

In addition, FIGS. 3 and 4 show still another type of conventional ratchet wrench 1C in which the base seat 2 is secured by a protective frame 12 without any rivet 11. The upper and lower bars 3, 4 are identical to each other. However, the protective frame 12 elongates the total length of the wrench so that the wrench will occupy more room and it is relatively difficult to assemble the wrench (because driving blocks 52 are protruded).

SUMMARY OF THE INVENTION

In order to obviate the above problems, it is a primary object of the present invention to provide a base seat of a ratchet wrench, which can be secured without using any rivet.

It is a further object of the present invention to provide the above base seat which occupies less room and can be easily assembled.

The present invention can be best understood through the following description and accompanying drawings, wherein:

DETAILED DESCRIPTION OF THE PREFERRED EMBODIMENTS

Figure 1:
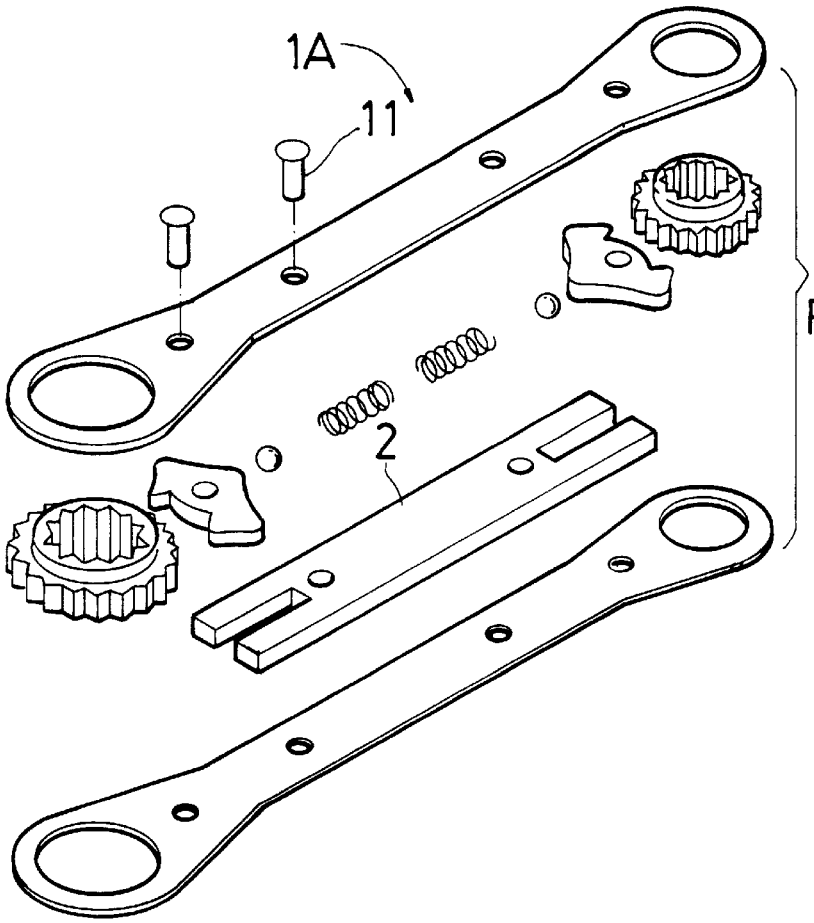
FIG. 1 PRIOR ART
FIG. 1 is a perspective exploded view of a conventional ratchet wrench.
Figure 2:
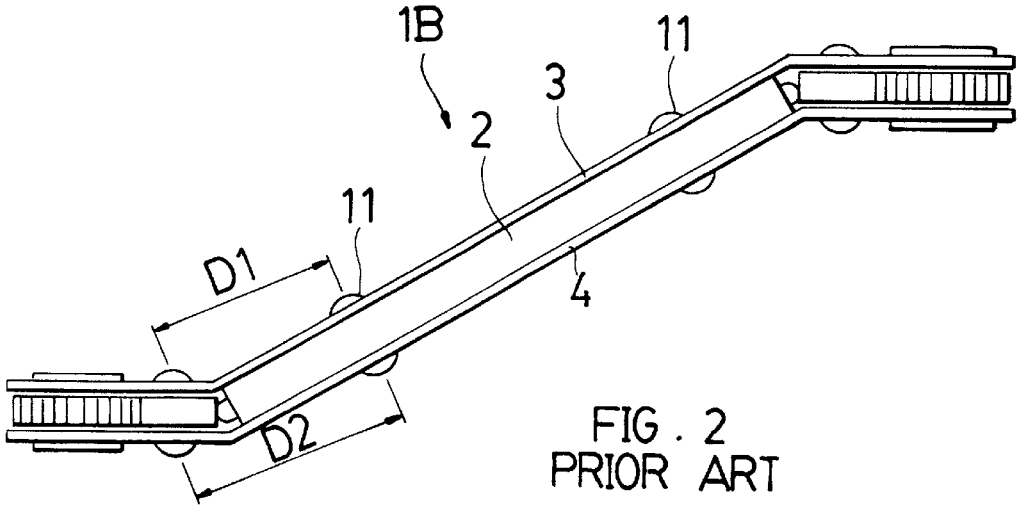
FIG. 2 PRIOR ART
FIG. 2 is a sectional view of another type of conventional ratchet wrench.
Figure 3:
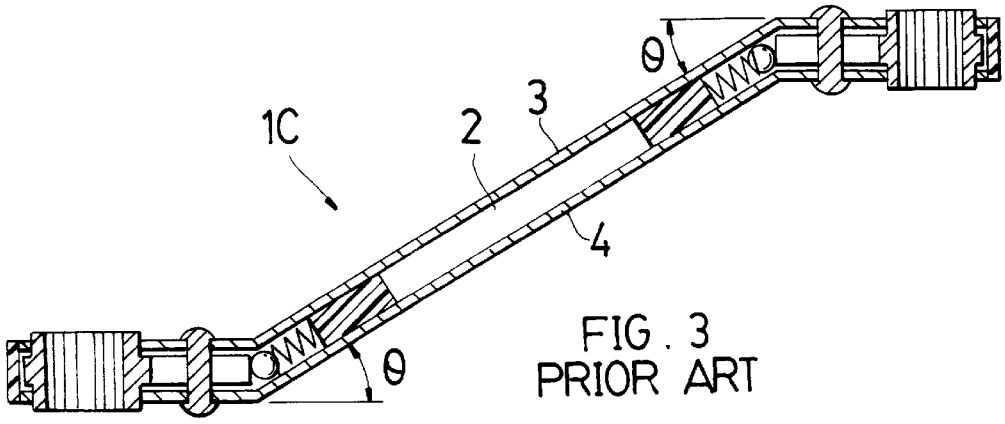
FIG. 3 PRIOR ART
FIG. 3 is a sectional view of still another type of conventional ratchet wrench.
Figure 4:
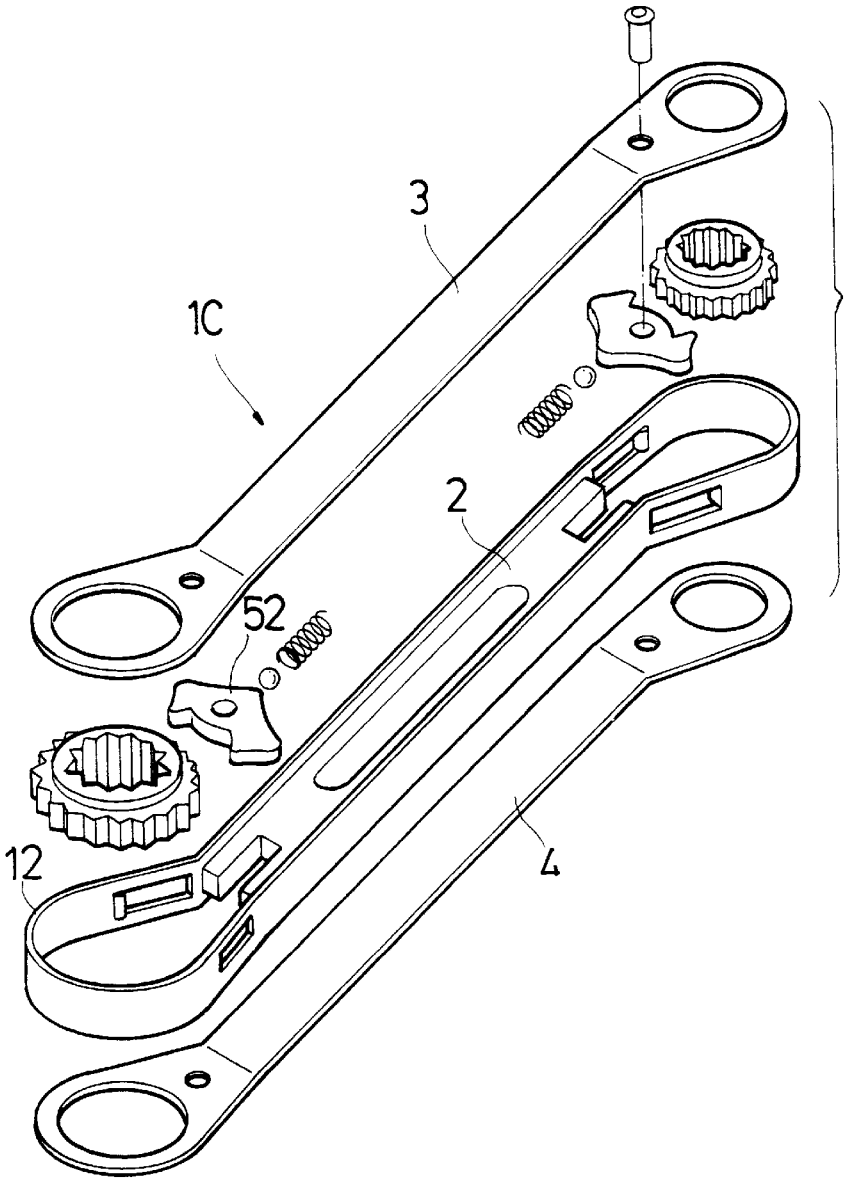
FIG. 4 PRIOR ART
FIG. 4 is a perspective exploded view according to FIG. 3.
Figure 5:
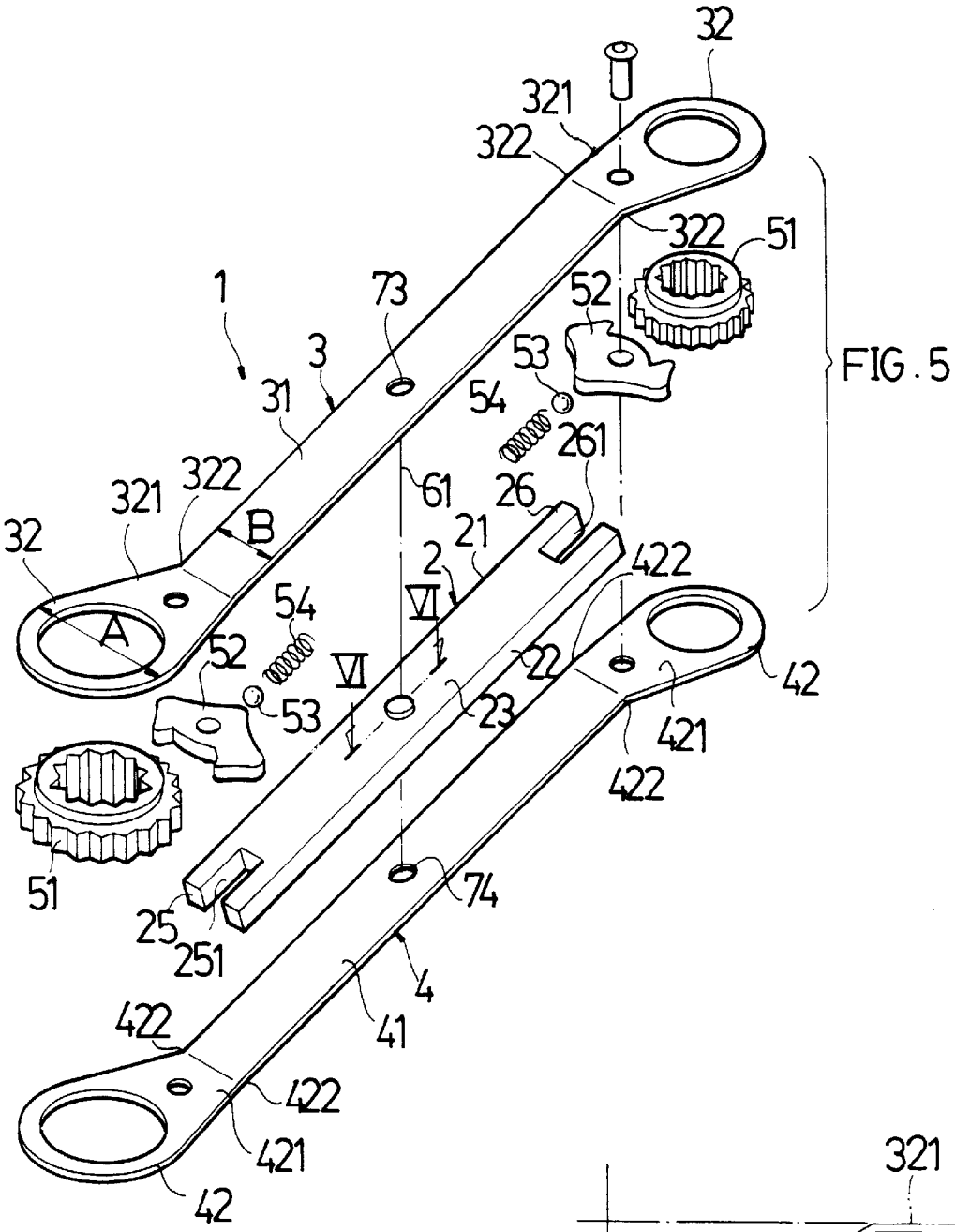
FIG. 5 is a perspective exploded view of a first embodiment of the present invention.
Figure 6:
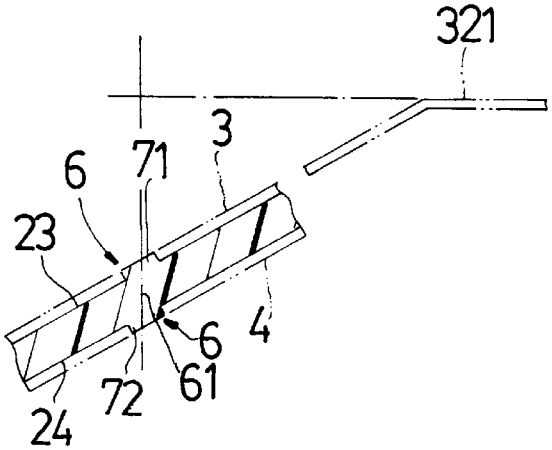
FIG. 6 is a sectional assembled view of a part of the first embodiment of the present invention.

Please refer to FIGS. 5 and 6 which show a first embodiment of the present invention. The ratchet wrench 1 includes a base seat 2 and upper and lower bars 3, 4 which are identical to each other. The upper and lower bars 3, 4 respectively include grip sections 31, 41 at central portions and two end sections 32, 42 bent up by a certain angle. Each end section 32, 42 has a reference plane face 321, 421. The largest width A of the end section of the ratchet wrench is larger than the width B of the grip section thereof. Four angle sections 322, 422 are defined between the end sections 32, 42 and the grip sections 31, 41. Each end section 32, 42 is disposed with a ratchet 51, a driving block 52 and a detent 53 which are drivingly connected with each other.

The base seat 2 is an elongated member having a length substantially equal to that of the grip sections 31, 41. The base seat 2 includes:

- two lateral faces 21, 22 which do not contact with the upper and lower bars 3, 4;
- a top face 23 substantially contacting with the upper bar 3;
- a bottom face 24 substantially contacting with the lower bar 4;
- two end faces 25, 26 respectively formed with notches 251, 261 for receiving springs 54 for providing a pushing force; and
- at least one pair of locating projections 6 respectively disposed on the top and bottom faces 23, 24 for preventing the base seat 2 from longitudinal or transverse sliding on the upper and lower bars 3, 4. The connecting line 61 of each pair of projections 6 is substantially normal to the reference plane face 321, 421 of the end faces 32, 42.

According to a first embodiment of the ratchet wrench of the present invention, the top face 23 and bottom face 24 of the base seat 2 are respectively disposed with an upper and a lower locating bosses 71, 72 that define the locating projections 6. In addition, the upper and lower bars 3, 4 are respectively formed with corresponding upper and lower recesses 73, 74.

Accordingly, the base seat can be secured without using any rivet.

Figure 7:
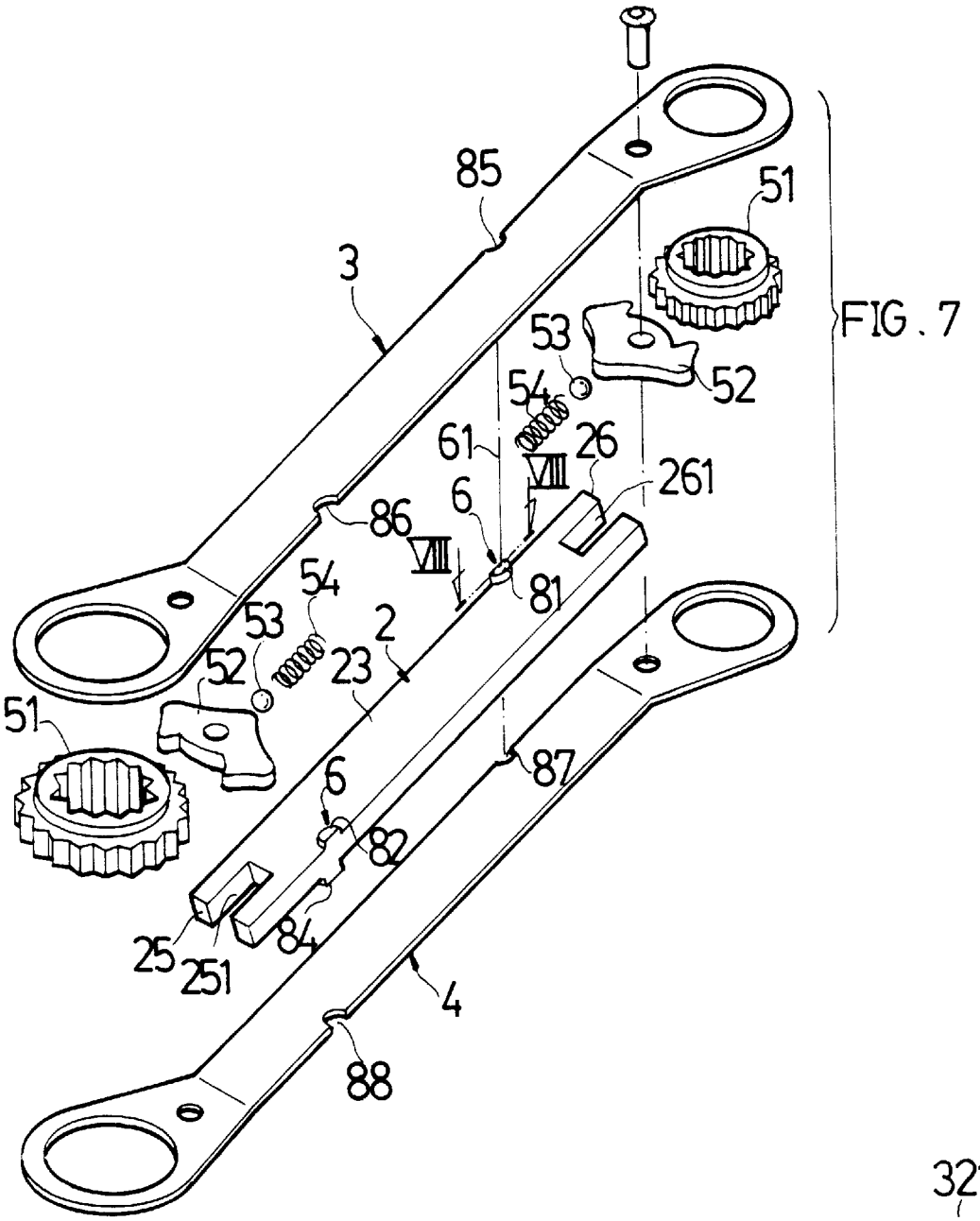
FIG. 7 is a perspective exploded view of a second embodiment of the present invention.
Figure 8:
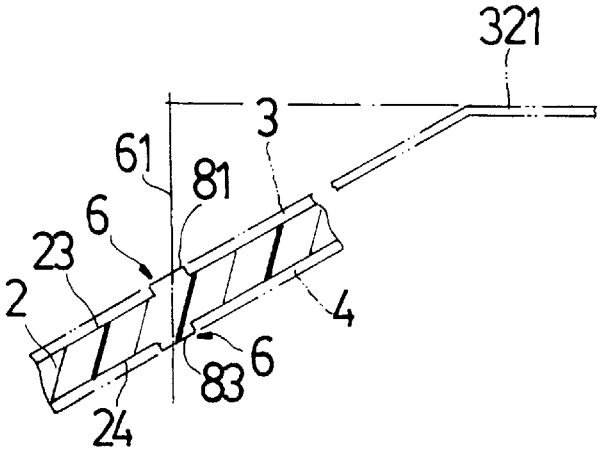
FIG. 8 is a sectional assembled view of a part of the second embodiment of the present invention.

FIGS. 7 and 8 show a second embodiment of the present invention, in which the top face 23 of the base seat 2 is disposed with first and second non-circular locating projections 81, 82. The bottom face of the base seat 2 is disposed with third and fourth locating projections 83, 84. In addition, the upper and lower bars 3, 4 are formed with corresponding first, second, third and fourth locating recesses 85, 86, 87 and 88.

Figure 9:
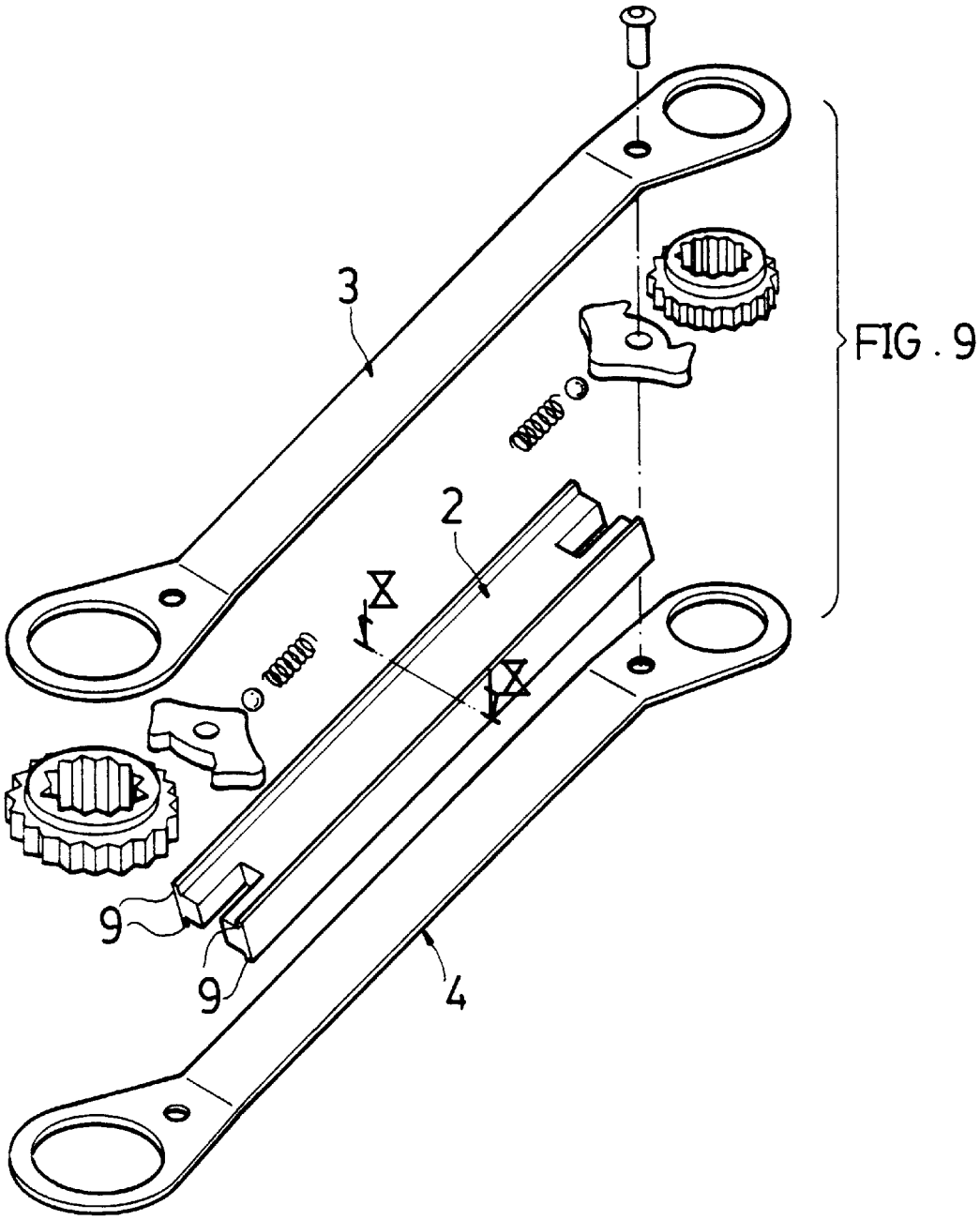
FIG. 9 is a perspective exploded view of a third embodiment of the present invention.
Figure 10:
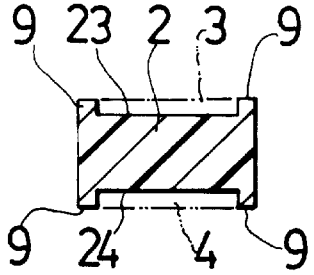
FIG. 10 is a sectional assembled view of a part of the third embodiment of the present invention.

FIGS. 9 and 10 show a third embodiment of the present invention, in which the top and bottom faces 23, 24 of the base seat 2 near the lateral faces 25, 26 are formed with upward and downward extending protective edges 9 having a length equal to that of the grip sections 31, 41. Therefore, the upper and lower bars 3, 4 are clamped by the protective edges and prevented from transversely sliding. Also, the protective edges 9 are stopped by the end sections 32, 42 of the ratchet wrench 1 so that the base seat is prevented from longitudinally sliding.

It is to be understood that the above description and drawings are only used for illustrating some embodiments of the present invention, not intended to limit the scope thereof. Any variation and derivation from the above description and drawings should be included in the scope of the present invention.

What is claimed is:

1. An offset ratchet wrench, comprising:

identical upper and lower bars disposed in spaced relationship, each of said bars having a pair of opposing end sections with a grip section formed therebetween, said grip section having an opening formed therein, each of said end sections being angularly offset with respect to said grip section of a respective one of said bars, an upper surface of at least one of said end sections defining a reference plane;

a pair of ratchets respectively disposed between said end sections of said upper and lower bars;

a pair of driving blocks respectively disposed between said end sections of said upper and lower bars and engaged with a respective one of said pair of ratchets a longitudinally extended base seat disposed between said grip sections of said upper and lower bars, said base seat having an upper surface with a first projection extending therefrom and inserted into said opening of said grip section of said upper bar, said base seat having a lower surface with a second projection extending therefrom and inserted into said opening of said grip section of said lower bar, said second projection being longitudinally displaced with respect to said first projection, wherein a line projecting through said first and second projections is substantially normal to said reference plane; and, a pair of spring biased detents respectively disposed in said slotted openings of said base seat and drivingly contacting a respective one of said pair of ratchets.

2. An offset ratchet wrench, comprising:

identical upper and lower bars disposed in spaced relationship, each of said bars having a pair of opposing end sections with a grip section formed therebetween, said grip section having a pair of recesses formed in opposing side edges thereof, each of said end sections being angularly offset with respect to said grip section of a respective one of said bars, an upper surface of at least one of said end sections defining a reference plane;

a pair of ratchets respectively disposed between said end sections of said upper and lower bars;

a pair of driving blocks respectively disposed between said end sections of said upper and lower bars and engaged with a respective one of said pair of ratchets a longitudinally extended base seat disposed between said grip sections of said upper and lower bars and having a pair of slotted openings respectively formed in opposing ends thereof, said base seat having an upper surface with a pair of first projections extending therefrom and respectively inserted into said pair of recesses of said grip section of said upper bar, said base seat having a lower surface with a pair of second projection extending therefrom and respectively inserted into said pair of recesses of said grip section of said lower bar, each of said second projections being longitudinally displaced with respect to a corresponding one of said first projections, wherein a line projecting through corresponding ones of said first and second projections is substantially normal to said reference plane; and, a pair of spring biased detents respectively disposed in said slotted openings of said base seat and drivingly contacting a respective one of said pair of ratchets.

3. An offset ratchet wrench, comprising:

identical upper and lower bars disposed in spaced relationship, each of said bars having a pair of opposing end sections with a grip section formed therebetween, each of said end sections being angularly offset with respect to said grip section of a respective one of said bars;

a pair of ratchets respectively disposed between said end sections of said upper and lower bars;

a pair of driving blocks respectively disposed between said end sections of said upper and lower bars and engaged with a respective one of said pair of ratchets a longitudinally extended base seat disposed between said grip sections of said upper and lower bars and having a pair of slotted openings respectively formed in opposing ends thereof, said base seat having a pair of protective edges formed on opposing lateral sides thereof, each of said pair of protective edges extending beyond both an upper surface of said base seat and a lower surface thereof, each said protective edge extending longitudinally a distance equal to a length of said base seat for respectively, wherein said grip sections of said upper and lower bars are captured between said protective edges; and, a pair of spring biased detents respectively disposed in said slotted openings of said base seat and drivingly contacting a respective one of said pair of ratchets.

* * * * *